US008528127B1

(12) United States Patent
Gabaldon

(10) Patent No.: US 8,528,127 B1
(45) Date of Patent: Sep. 10, 2013

(54) PORTABLE AND FOLDING TOILET TRANSPORT CHAIR AND METHOD OF USING

(76) Inventor: Harry E. Gabaldon, Belen, NM (US)

( * ) Notice: Subject to any disclaimer, the term of this patent is extended or adjusted under 35 U.S.C. 154(b) by 1388 days.

(21) Appl. No.: 11/566,108

(22) Filed: Dec. 1, 2006

Related U.S. Application Data

(60) Provisional application No. 60/762,108, filed on Jan. 26, 2006.

(51) Int. Cl.
*A47K 11/06* (2006.01)

(52) U.S. Cl.
USPC ..... 4/661; 4/480; 4/483; 4/484

(58) Field of Classification Search
USPC ..... 4/450, 479–484, 661, 667, 452, 315, 4/312, 514, 238, 254; 5/604
See application file for complete search history.

(56) References Cited

U.S. PATENT DOCUMENTS

| | | | | |
|---|---|---|---|---|
| 1,869,036 | A | | 7/1932 | Zink |
| 1,872,809 | A | | 8/1932 | Randall |
| 2,204,343 | A | | 6/1940 | Dawson |
| 2,592,405 | A | * | 4/1952 | Everest et al. ..... 297/42 |
| 2,680,854 | A | | 6/1954 | Phillips |
| 3,666,131 | A | | 5/1972 | Thompson |
| 3,757,355 | A | | 9/1973 | Allen et al. |
| 4,334,330 | A | | 6/1982 | Marshall |
| 4,920,587 | A | | 5/1990 | Kerr |
| 5,062,165 | A | * | 11/1991 | Kerr ..... 4/480 |
| 5,333,333 | A | * | 8/1994 | Mah ..... 5/87.1 |
| 5,384,920 | A | | 1/1995 | Havens |
| 5,970,529 | A | | 10/1999 | Veal |
| 6,039,403 | A | * | 3/2000 | Hargroder ..... 297/440.24 |
| 6,101,646 | A | | 8/2000 | Chong |
| 6,418,571 | B1 | * | 7/2002 | Cheng ..... 4/480 |
| 6,547,265 | B1 | * | 4/2003 | Enge et al. ..... 280/47.38 |

FOREIGN PATENT DOCUMENTS

| | | |
|---|---|---|
| JP | 2002191647 | 7/2002 |
| JP | 2006081595 | 3/2006 |

* cited by examiner

*Primary Examiner* — Gregory Huson
*Assistant Examiner* — Timothy P Kelly
(74) *Attorney, Agent, or Firm* — Deborah A. Peacock; Justin R. Jackson; Peacock Myers, P.C.

(57) ABSTRACT

A portable toilet and method of using which is foldable or not foldable and which is easily mounted, used, and dismounted by a handicapped and/or bedridden person. The handicapped and/or bedridden person can be transported while disposed on the toilet.

11 Claims, 8 Drawing Sheets

PORTABLE AND FOLDING TOILET TRANSPORT CHAIR AND METHOD OF USING

CROSS-REFERENCE TO RELATED APPLICATIONS

This application claims priority to and the benefit of the filing of U.S. Provisional Patent Application Ser. No. 60/762,108, entitled "Portable Folding Toilet", filed on Jan. 26, 2006, and the specification thereof is incorporated herein by reference.

BACKGROUND OF THE INVENTION

1. Field of the Invention (Technical Field)

The present invention relates to a portable toilet, particularly to a portable toilet which can be easily mounted, folded, used, and dismounted by a handicapped person.

2. Description of Related Art

Note that the following discussion refers to a number of publications by author(s) and year of publication, and that discussion of such publications herein is given for more complete background and is not to be construed as an admission that such publications are prior art for patentability determination purposes.

Prior art devices that are directed to assisting a bedridden patient in performing a restroom function do not provide a patient the ability to assume a fully seated position and thus are not only uncomfortable and make performance of restroom functions more difficult, but because prior art devices force a patient to perform restroom functions in an awkward and unnatural position, the prior art devices also remove the dignity of those patients who are forced to use them. U.S. Pat. No. 2,204,343 to Dawson is directed to a bedpan device wherein the bedridden patient must lift or have assistants raise his or her buttocks so that the seat can be disposed beneath the patient's buttocks. The seat is then raised via a crank device until a sufficient height is achieved whereupon a bedpan is inserted below the patient's buttocks. Patients subjected to the Dawson device are thus forced to perform a restroom function while slightly elevated above the patient's bed.

U.S. Pat. No. 2,680,854 to Phillips describes a device which holds a bed pan. The Phillips device cannot be raised above a bed while a patient is disposed thereon, nor can it be horizontally moved away from a bed. A patient is thus forced to perform restroom functions into the bedpan, which is not equipped with a toilet seat, while the user remains in bed. U.S. Pat. No. 3,666,131 to Thompson describes a bedpan carrier which presses a bedpan into the patient's bed. The patient then attempts to perform a restroom function while the bedpan is pressed into the user's bed. Like the Thompson bedpan carrier, the sanitary bedpan of U.S. Pat. No. 1,869,036 to Zink is also to be used by a patient while the patient remains in bed.

There is thus a present need for a method and apparatus which provide a patient the ability to perform a restroom function while sitting in a more conventional position and which further provides the patient the dignity of not being required to excrete waste while lying in his or her bed.

BRIEF SUMMARY OF THE INVENTION

The present invention relates to a portable toilet. Some of the advantages of embodiments of the present invention include: reducing the number of assistants required to assist a bedridden patient onto and off of a toilet to only one; decreasing the likelihood of a patient and/or caretaker sustaining injuries while a patient is transferred from a bed to a toilet; and improving circulation of a patient by permitting the patient to easily assume a sitting position while performing restroom functions.

An embodiment of the present invention relates to a portable toilet having one or more wheels, a generally horizontal seat having an opening, the seat is positionable over a bed, and a removably positionable container positioned beneath the opening of the seat, wherein the portable toilet is horizontally movable while a patient is sitting on it. Optionally, the removably positionable container can have or otherwise use a disposable liner.

In one embodiment, the portable toilet can also have a removably positionable back rest, which can be positionable while a patient is sitting on the portable toilet. The removably positionable back rest can have one or more support braces.

The portable toilet can optionally have one or more handles, a support arm that can be rotatable about a base of the portable toilet, removably positionable support braces, and/or a base. The base is preferably shaped and/or otherwise has sidewalls to contain spills.

In one embodiment, the portable toilet of the present invention is preferably foldable. Optionally, the toilet is substantially or completely foldable into a base of the toilet.

An embodiment of the present invention also relates to a method for using a portable toilet which includes positioning a patient's buttocks onto a seat of the portable toilet while the patient is lying on a bed, the patient assuming a substantially sitting position on the seat, generally horizontally removing the seat and patient away from the bed, and returning the patient to the bed after use of the portable toilet.

In one embodiment of the method, returning the patient to the bed can include positioning the seat and the user over an upper surface of the bed. Preferably, the patient lies on his or her backside after being positioned over the bed. The patient is then preferably positioned onto his or her side after being returned to the bed and after first lying on his or her backside.

Positioning a patient's buttocks onto a seat can include the patient positioned onto his or her side and the seat disposed behind the patient's buttocks. The seat is preferably generally horizontally moved away from the bed after the patient is returned to the bed.

The method can optionally include attaching a seatback to the portable toilet after the user is seated on it; adjusting the height of the seat; attaching a patient's limb to a support arm of the toilet; disposing a removably positionable container below the opening in the seat; and/or folding or at least partially disassembling the toilet after use.

An embodiment of the present invention also relates to a method for reducing the number of helpers required to assist a handicapped or very obese person in performing a restroom function including: an individual helper rolling a patient onto the patient's side on a bed; an individual helper positioning a toilet seat behind a user's buttocks; an individual helper rolling a patient onto his or her back, thus disposing the users buttocks onto the toilet seat; an individual helper assisting the patient to assume a sitting position on the seat; and an individual helper moving the seat, with patient seated thereon, horizontally away from the bed.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
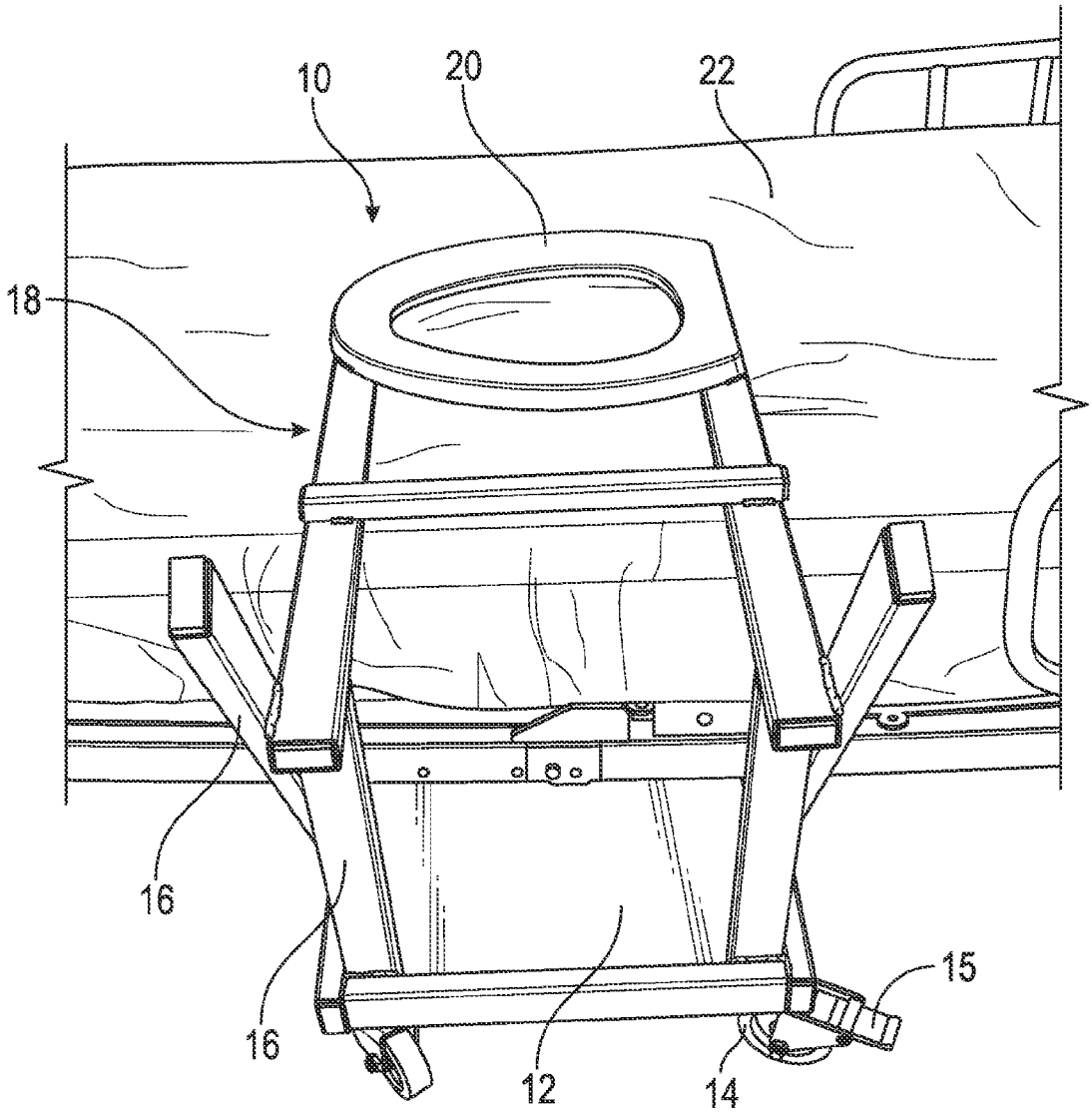
FIG. 1 is a photograph illustrating an embodiment of the present invention wherein the seat of the toilet is illustrated directly above a surface of a bed.

Aspects of the present invention are illustrated in the drawings and described herein. Embodiments of the present invention relate to a portable toilet which provides most desirable results when used by a bedridden patient. The present invention comprises embodiments which are directed to portable toilets which are foldable and embodiments which are directed to portable toilets which are not foldable, particularly for a heavier-set person.

The term "wheels" as used throughout the specification and claims is used for the sake of simplicity and is intended to include any and all apparatuses, structures, elements, materials, methods or combinations thereof which facilitate, or otherwise make easier, the movement of the toilet of the present invention. Accordingly, the term "wheels" includes, but is not limited to, one or more wheels, castors, sliders, gliders, rollers, combinations thereof, and the like.

As illustrated in FIG. 1, an embodiment of the present invention relates to portable toilet 10, which preferably has base 12 attached to wheels 14, to facilitate movement of toilet 10, particularly horizontal movement of toilet 10 when a patient is disposed thereon. In one embodiment, entire toilet 10 is optionally horizontally removed away from the bed. Although the embodiment illustrated in FIG. 1 is not foldable, other embodiments of the present invention are directed to portable toilets which are foldable or can otherwise be quickly disassembled and stored away. The wheels of the present invention can also optionally be provided with one or more locking and/or braking mechanisms 15 which are optionally selectively activated. When locking and/or braking mechanisms 15 are activated or otherwise enabled, portable toilet 10 preferably resists forces which would otherwise cause toilet 10 to move. Upright structure(s) 16 are preferably provided which support upper assembly 18 which preferably has seat 20 attached thereto. In addition to providing support to upper assembly 18, upright structure(s) 16 can extend above upper assembly 18 and thus provide one or more handles which can be grasped by a user and used to maneuver portable toilet 10 before and after use by a patient. Seat 20 is preferably attached to a structure which permits its disposal onto and removal from bed 22. The configuration or design of any of the foregoing is not essential and those skilled in the art will readily recognize alternative manners and structures for achieving substantially similar results after studying this application.

Embodiments of the present invention achieve particularly desirable results when used in conjunction with patients who are handicapped and/or infirm. Accordingly, embodiments of the present invention often achieve particularly desirable results when used in conjunction with a hospital bed or other similar structure.

Figure 2:
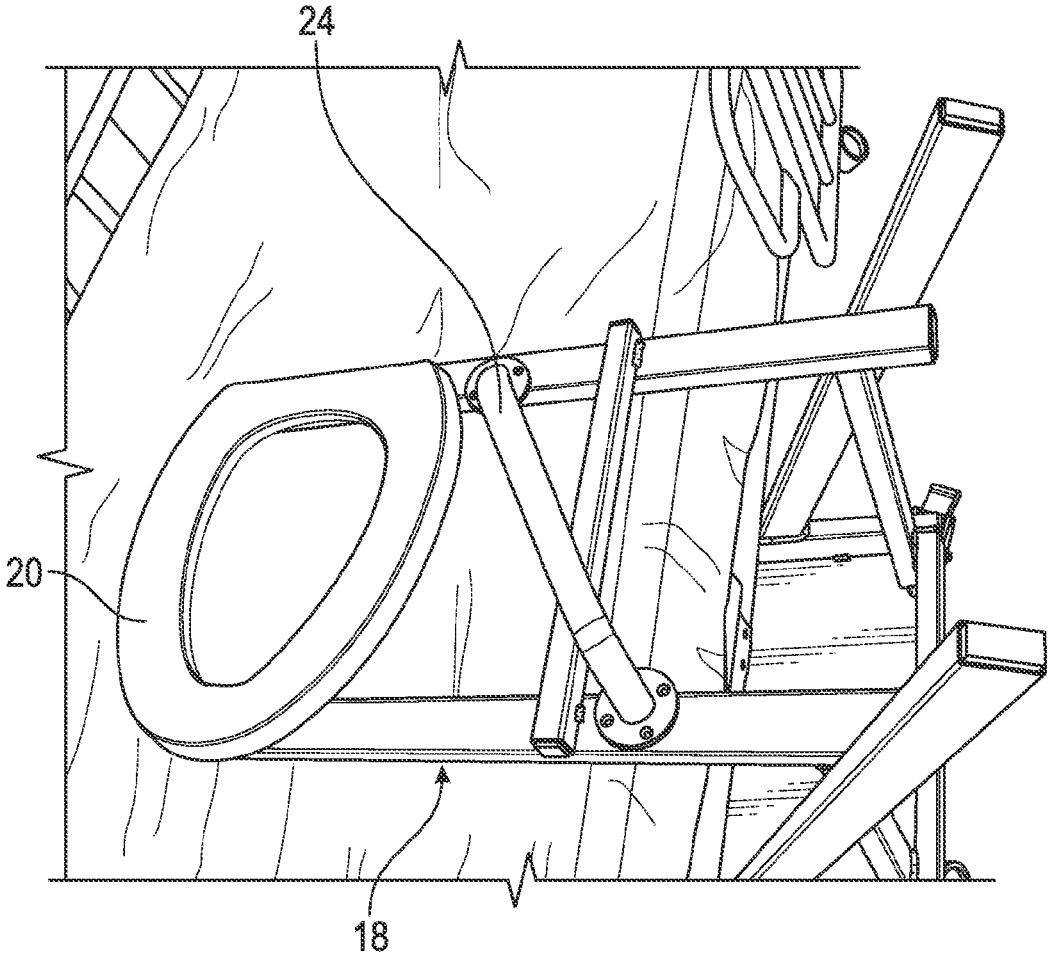
FIG. 2 is a photograph illustrating an embodiment of the present invention wherein a handle is provided.

FIG. 2 illustrates another embodiment of the present invention wherein one or more handles 24 or other apparatuses are preferably attached to toilet 10 to provide a patient with a structurally sound gripping area.

Figure 3:
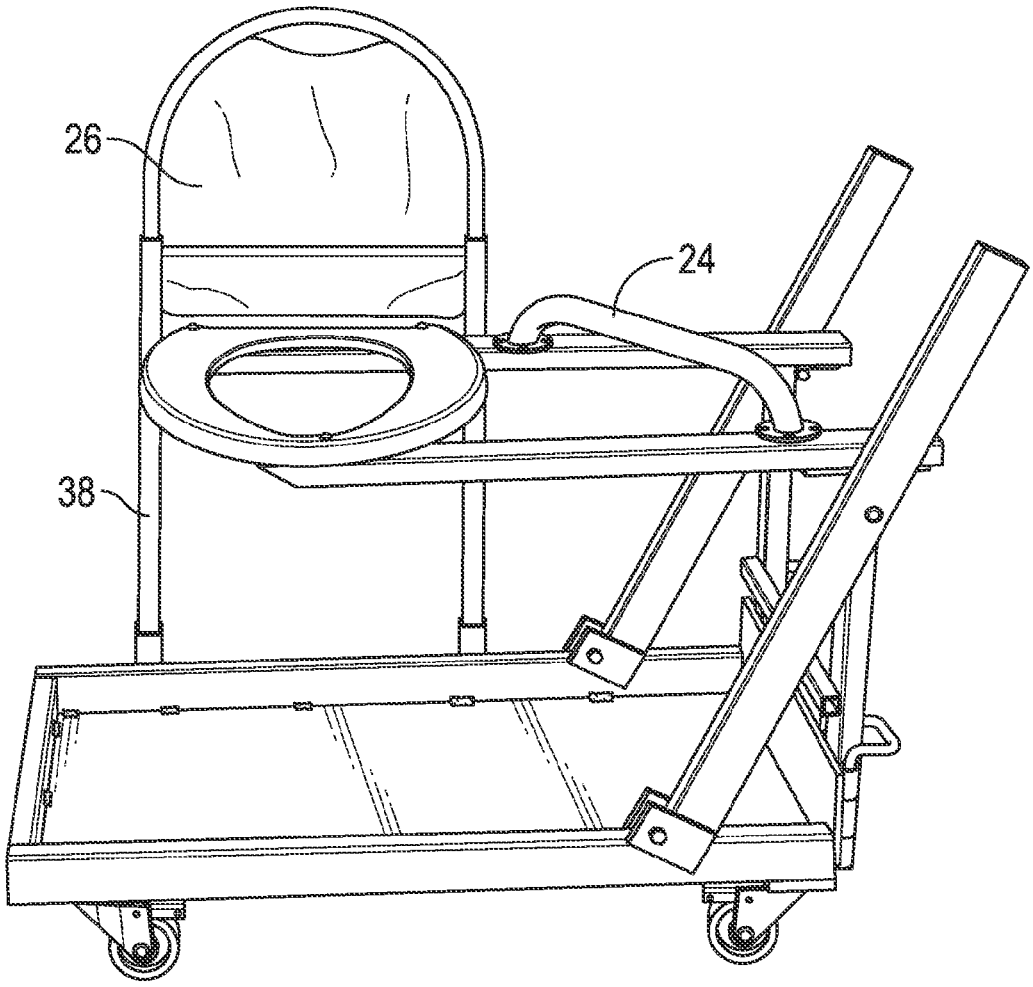
FIG. 3 is a photograph illustrating an embodiment of the present invention wherein a seat back and removably positionable supports are provided.
Figure 4:
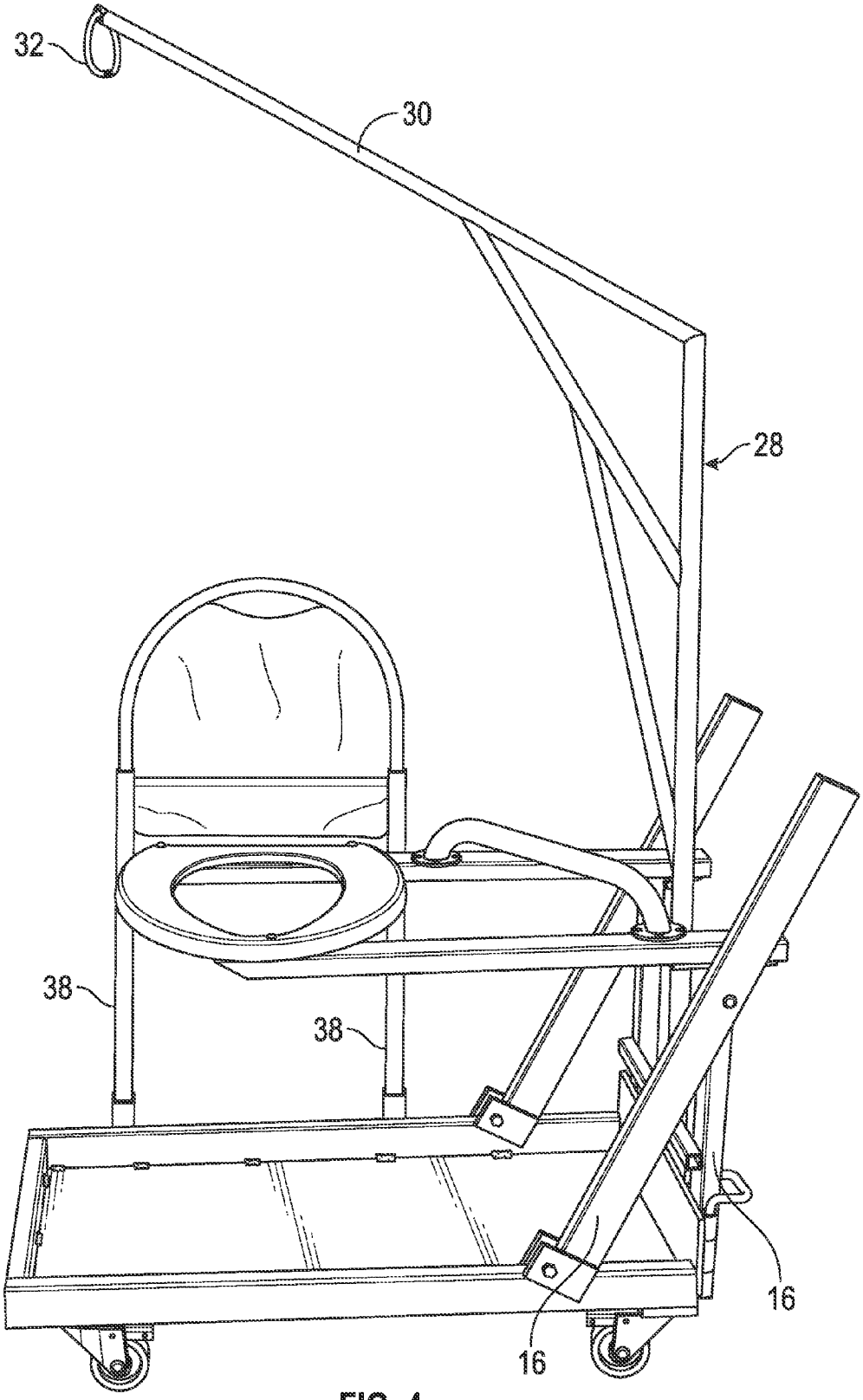
FIG. 4 is a photograph illustrating an embodiment of the present invention wherein an arm with an attachment mechanism is provided.

As illustrated in FIG. 3, seat back 26 is optionally added to toilet 10. In this embodiment of the present invention, seat back 26 is preferably removably attached to toilet 10 through any fastener, system, method, apparatus, or combination thereof known to those skilled in the art.

In another embodiment of the present invention, toilet 10 preferably has support arm 28 or another apparatus attached thereto. In this embodiment, support arm 28 is most preferably attached to base 12 of toilet 10 in such a manner that support arm 28 rotates with respect to base 12. In another embodiment of the present invention, support arm 28 is rigidly and fixedly connected to toilet 10, or arm 28 is removably positionable with respect to toilet 10. In another alternative embodiment of the present invention, upper arm portion 30 of support arm 28 is optionally configured to raise and/or lower in a manner similar to an engine hoist or another similar structure. In another embodiment of the present invention, attachment mechanism 32 is preferably disposed or otherwise positioned on upper arm portion 30 of support arm 28. The configuration and/or type of attachment mechanism 32 is not essential to the present invention, and desirable results can be produced from virtually any attachment mechanism known to those skilled in the art to which a sling, rope, clip, strap, clasp, or similar apparatus and/or combinations thereof can be attached. In one embodiment, seat 20 of toilet 10 is preferably disposed above base 12 a distance which permits a patient to rest his or her feet on base 12 while seated on seat 20. In alternative embodiments of the present invention, base 12 preferably comprises a shape which contains any spills. For example, base 12 can comprise a bowl shape and/or a plurality of sides.

Figure 5:
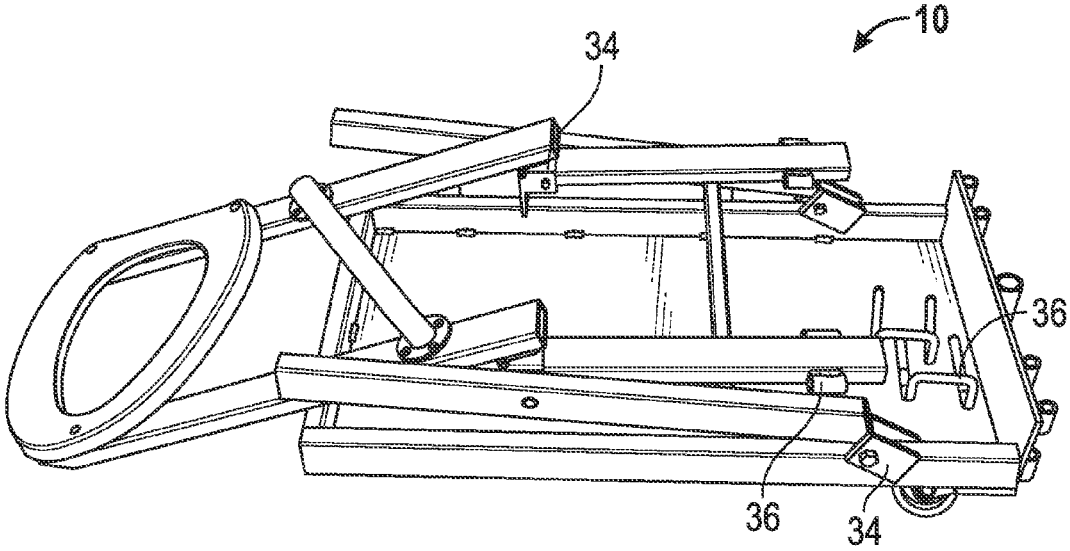
FIG. 5 is a photograph illustrating an embodiment of the present invention wherein the toilet of the present invention is folded and partially disassembled position.
Figure 6:
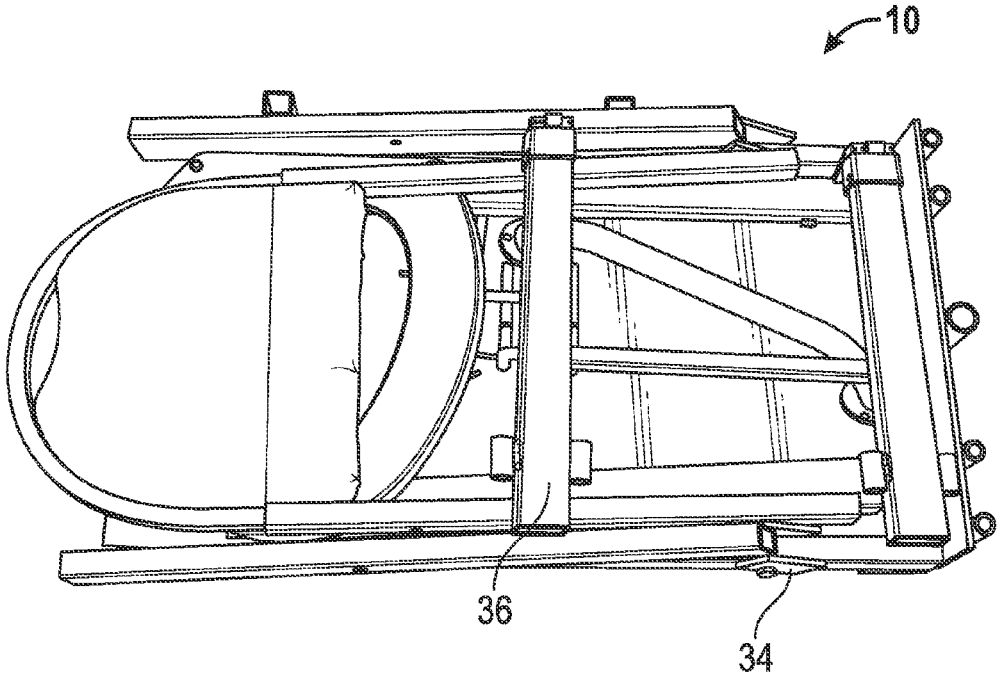
FIG. 6 is a photograph illustrating an embodiment of the present invention wherein the toilet of the present invention is folded and stowed in a compact and self-contained fashion.
Figure 7:
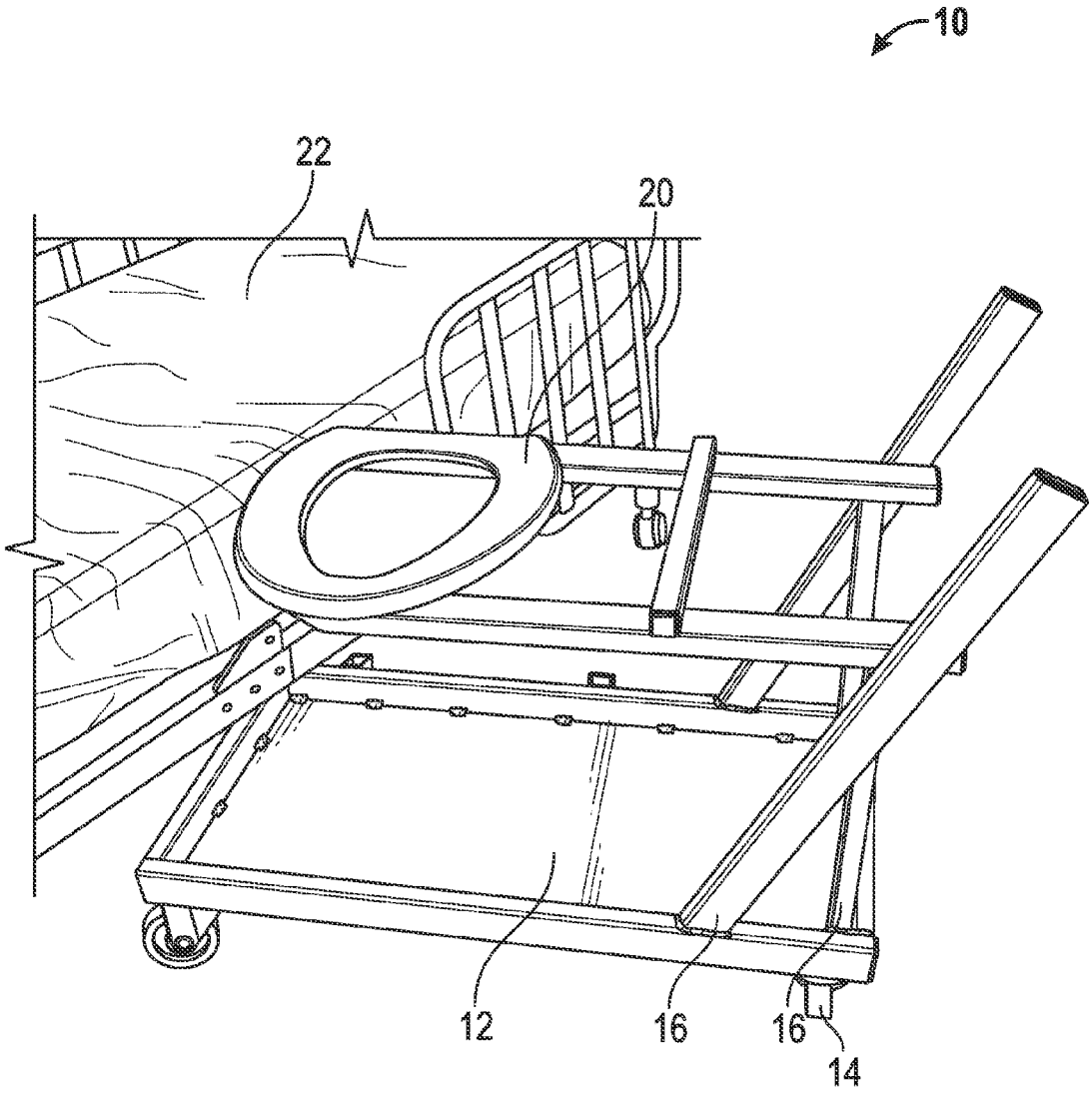
FIG. 7 is a photograph illustrating an embodiment of the present invention wherein an assistant is positioning the toilet onto a bed.

FIGS. 5 and 6 illustrate embodiments of the present invention wherein toilet 10 comprises hinged and/or foldable portions 34 and/or removably positionable components 36 of toilet 10 which permit toilet 10 to be disassembled and/or folded, thus allowing toilet 10 to be stored in a relatively confined space.

Although the present invention achieves particularly desirable results when used with a hospital or other height adjustable bed, such that the bed height can be adjusted such that seat 20 of toilet 10 is disposed just above a top surface thereof, in alternative embodiments of the present invention, toilet 10 optionally comprises one or more mechanisms which permit the height of seat 20 and/or upper assembly 18 to be adjusted. These height-adjustable embodiments of the present invention provide particularly desirable results when used in conjunction with beds which do not have a height-adjustment feature. Those skilled in the art will readily recognize numerous manners for achieving a height adjustment, including but not limited to a jack-type of mechanism; a plurality of holes disposed in slidable upright structure(s) 16 which can be extended and through which holes one or more pegs can be inserted once a desired height is achieved, etc.

Figure 10:
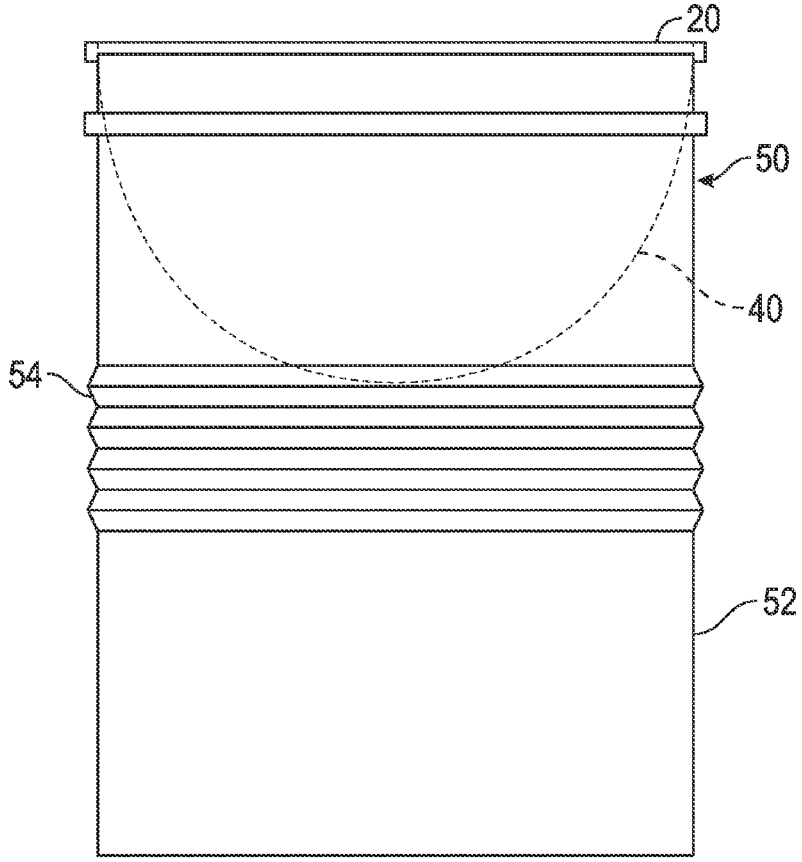
FIG. 10 is a drawing illustrating an embodiment of the present invention wherein an expandable container is removably positionable beneath a seat of the toilet of the present invention.
Figure 11:
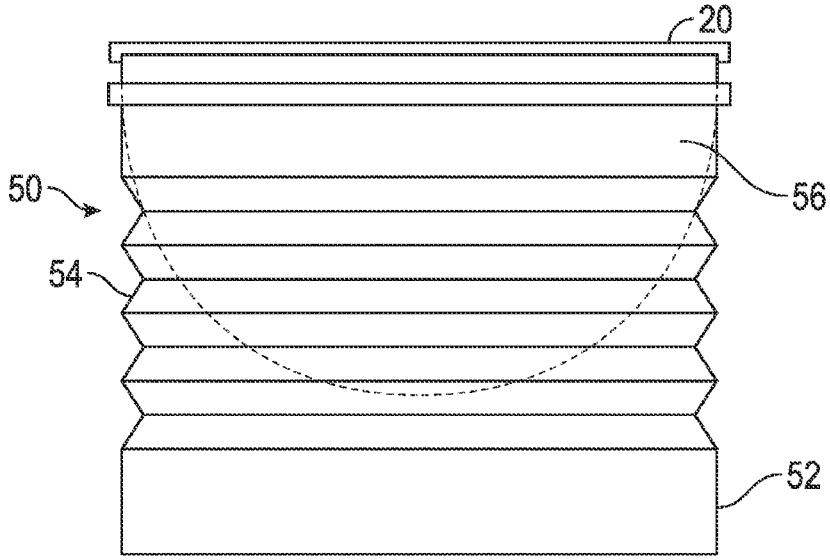
FIG. 11 is a drawing illustrating an embodiment of the present invention wherein an expandable container containing a disposable liner is removable positionable beneath the seat of the toilet of the present invention.

FIG. 10 illustrates an embodiment of the present invention wherein seat 20 has container 40 disposed therebelow. In this embodiment second container 50 is preferably provided. Second container 50 preferably comprises one or more vertical sides 52 with one or more accordion-type expandable sections 54. While second container 50 preferably comprises a plastic material, those skilled in the art will readily identify numerous materials and/or combinations thereof that can be used to construct second container 50. Second container 50 can easily be placed beneath seat 20 in a collapsed state and then and then expanded to connect to, abut to, or otherwise nearly abutted to seat 20, such that any spills which may occur are entrapped within second container 50. Alternatively, container 40 can be disposed such that it rests upon second container 50 and can thus be caused to abut to, or otherwise connect to seat 20 by simply extending accordion-type supplemental container 50. In addition to, or as an alternative to the foregoing (see FIG. 11), accordion-type second container 50 can be fitted with disposable liner 56, such as a trash bag or the like, and then expanded such that disposable liner 56 contacts, or nearly contacts seat 20, thus catching and containing all of the waste of the patient, if used without container 40, or to catch and contain any spilled waste if used in addition to container 40. As such, second container 50, with disposable liner 56 disposed therein can optionally be the only container used.

Referring to the Figures now generally, to use the present invention, a patient is preferably instructed and/or assisted in rolling onto his or her side facing away from a first side of bed 22. An assistant preferably positions toilet 10 such that seat 20 is positioned above, but very near to a top of bed 22. As best illustrated in FIG. 1, toilet 10 is then slid, rolled, and/or otherwise disposed into position from a first side of bed 22 such that seat 20 is positioned next to the buttocks of the patient that is positioned on his or her side facing away from toilet 10. Accordingly, base 12 of toilet 10 is preferably disposed beneath the bed. After toilet 10 is so positioned, the patient is then instructed and/or assisted in rolling onto his or her back such that the patient's buttocks are now disposed on seat 20. If a patient has a limb which needs to remain in a fixed position, such as a leg in a sling, support arm 28 can be used such that the limb is connected to attachment mechanism 32 with a sling, rope, clip, strap, clasp, or similar apparatus and/or combinations thereof, thus preventing further injury to the injured limb. The patient is then instructed and or assisted in sitting up onto seat 20. In embodiments of the present invention where removably positionable seat back 26 is provided, it is preferably installed and/or otherwise attached to toilet 10 just after a patient has sat upright on seat 20. An assistant then slides, rolls, or otherwise removes toilet 10 from bed 22. In embodiments of the present invention wherein toilet 10 is provided with handle 24, a patient optionally grasps handle 24 while an assistant moves toilet 10 away from bed 22.

Optionally, in one embodiment of the present invention, an assistant installs one or more removably positionable support members 38 to toilet 10 such that seat 20 and/or upper assembly 18 is better supported above base 12. If used, additional support members are installed when toilet 10 has been removed almost completely from bed 22, but while an end portion of upper assembly 18 is still partially supported by bed 22. Alternatively, if used, additional support members are installed after toilet 10 has been removed completely from bed 22.

Figure 8:
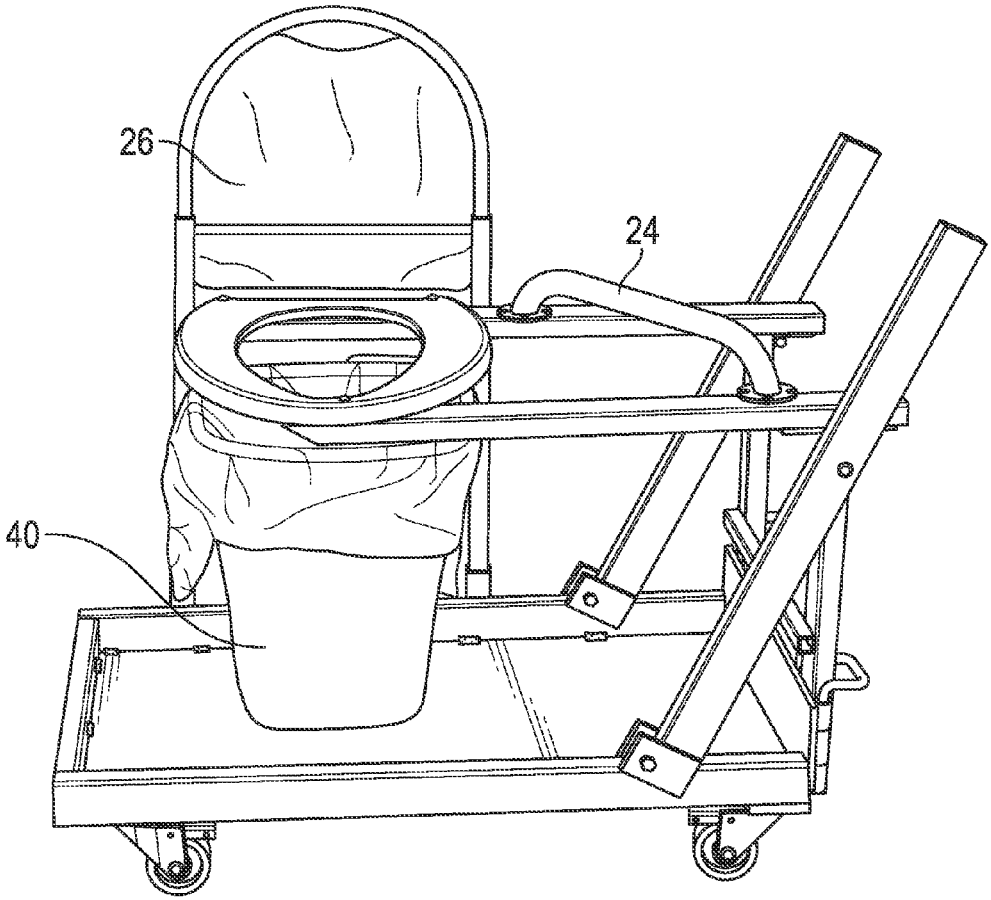
FIG. 8 is a photograph illustrating an embodiment of the present invention wherein a container with a disposable liner is disposed below a seat of the toilet of the present invention.
Figure 9:
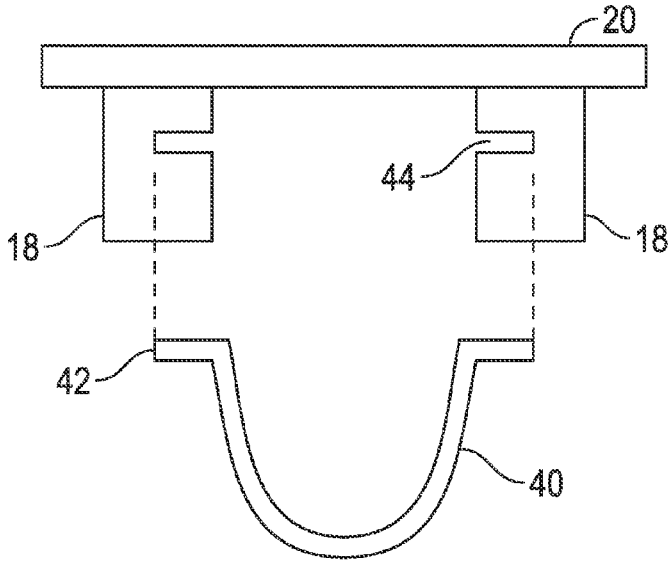
FIG. 9 is a drawing illustrating an embodiment of the present invention wherein a container is slidably positionable beneath a seat of the toilet of the present invention.

After toilet 10, with a patient sitting thereon, has been removed from bed 22, container 40 is preferably disposed beneath seat 20 such that waste from the patient can be collected therein. FIGS. 8 and 9 illustrate only a couple of the numerous manners in which container 40 can be positioned and/or disposed beneath seat 20. As illustrated in FIG. 8, a large container, such as a trash can, which can optionally be provided with a removable and disposable liner is placed on base 12 directly beneath seat 20. As illustrated in FIG. 9 container 40', which optionally resembles a bed pan, is provided with ears or flange 42 which are aligned with and slide into grooves 44 provided in upper assembly 18', thus permitting container 40' to be slid into position directly beneath seat 20. Although the Figures illustrate only a couple of the possibilities for positioning and/or attaching container 40 below seat 20, the present invention is not limited to only those embodiments illustrated; and those skilled in the art will recognize numerous manners and ways to position and/or attach container 40 below seat 20.

After the patient is finished performing his or her restroom function, the assistant is summoned. The assistant then preferably removes container 40 or 40' and disposes of its contents. The patient and toilet 10 are then preferably moved such that at least a portion of upper assembly 18 and/or seat 20 are disposed just above bed 22. If one or more removably positionable support members 38 were attached to toilet 10, then they are most preferably removed at this time. After removing any removably positionable support members 38, patient and toilet 10 are preferably positioned such that seat 20 is disposed above bed 22. If removably positionable seat back 26 was provided, it is preferably removed before the patient is instructed and/or assisted in lying on his or her back. At sometime when patient and toilet 10 are positioned above bed 22, if a user's limb was supported with support arm 28, the limb is preferably detached from support arm 28.

After the patient is lying on his or her back, the patient is instructed and/or assisted in rolling off of seat 20 and onto his or her side away from toilet 10. The assistant then preferably removes toilet 10 from bed 22 and instructs and/or assists the patient in assuming a comfortable position on bed 22.

In embodiments of the present invention wherein toilet 10 is foldable, or can otherwise be at least partially disassembled, a helper can then clean toilet 10 before folding and/or at least partially disassembling and subsequently storing toilet 10. In one embodiment of the present invention, toilet 10 is preferably folded and/or at least partially disassembled such that it comprises dimensions sufficient to permit it to be stored beneath a patient's bed.

While the foregoing describes some of the most preferred embodiments for use of the apparatus of the present invention, these steps are not essential to achieving desirable results with the present invention. Several embodiments of the present invention can achieve particularly desirable results without the use of cranks, ratcheting mechanisms, and other movable mechanical systems.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A method for using a portable and foldable toilet comprising:

rolling the portable and folding toilet to a side of a bed such that a primary axis of a seat is aligned with a primary axis of the bed;

supporting the seat with a plurality of vertical support members and at least one diagonal support member;

positioning a patient's buttocks onto a seat of the portable and folding toilet while the patient is lying lengthwise on a bed;

the patient assuming a substantially sitting position on the seat;

generally horizontally removing the seat and patient away from the bed;

catching waste in a removable waste container;

containing liquid spills within a base disposed underneath the toilet, the base surrounded by contiguous spill containing sides on all sides of the base, thereby sealing the base;

returning the patient to the bed after use of the portable and folding toilet; and folding the portable and folding toilet at least substantially down into the base.

2. The method of claim 1 wherein returning the patient to the bed comprises positioning the seat and the patient over an upper surface of the bed.

3. The method of claim 2 wherein the patient lays onto his or her backside after being positioned over the bed.

4. The method of claim 3 wherein the patient is positioned onto his or her side after being returned to the bed and laying on his or her backside.

5. The method of claim 1 wherein positioning a patient's buttocks onto a seat comprises the patient positioned onto his or her side and the seat disposed behind the patient's buttocks.

6. The method of claim 1 wherein the seat is generally horizontally moved away from the bed after the patient is returned to the bed.

7. The method of claim 1 further comprising attaching a seatback to the portable toilet after the patient is seated thereon.

8. The method of claim 1 further comprising adjusting the height of the seat.

9. The method of claim 1 further comprising the step of attaching a patient's limb to a support arm of the portable and folding toilet.

10. The method of claim 1 wherein the portable and folding toilet is at least partially disassembled after use.

11. A method for using a portable and foldable toilet comprising:

rolling the portable and folding toilet to a side of a bed such that a primary axis of a seat is aligned with a primary axis of the bed;

positioning a patient's buttocks onto a seat of the portable toilet while the patient is lying lengthwise on a bed;

the patient assuming a substantially sitting position on the seat;

generally horizontally removing the seat and patient away from the bed;

catching waste in a removable waste container;

containing liquid spills within a base disposed underneath the toilet, the base surrounded by contiguous spill containing sides on all sides of the base, thereby sealing the base;

returning the patient to the bed after use of the portable and folding toilet; and folding the portable and folding toilet at least substantially down into the base.

* * * * *